US008131169B2

(12) United States Patent
Kuntz et al.

(10) Patent No.: US 8,131,169 B2
(45) Date of Patent: Mar. 6, 2012

(54) APPARATUS AND METHOD FOR MOUNTING AN RF MONITORING DEVICE ONTO A FUSER ROLL

(75) Inventors: Alan R. Kuntz, Webster, NY (US); Saquiequois J. Bissouma, Webster, NY (US); Steven C. Hart, Webster, NY (US); Heiko Rommelmann, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 884 days.

(21) Appl. No.: 12/157,090

(22) Filed: Jun. 6, 2008

(65) Prior Publication Data

US 2009/0304400 A1 Dec. 10, 2009

(51) Int. Cl.
*G03G 15/00* (2006.01)
*G03G 15/20* (2006.01)

(52) U.S. Cl. ..... 399/33; 399/8; 399/9; 399/24

(58) Field of Classification Search ..... 399/33
See application file for complete search history.

(56) References Cited

U.S. PATENT DOCUMENTS

| | | | | |
|---|---|---|---|---|
| 5,156,469 | A * | 10/1992 | Tanaka et al. | 400/124.03 |
| 6,016,409 | A | 1/2000 | Beard et al. | 399/33 |
| 6,438,329 | B1 | 8/2002 | Budnik et al. | 399/24 |
| 7,146,112 | B2 | 12/2006 | Phipps et al. | 399/12 |
| 7,197,633 | B2 | 3/2007 | Rommelmann et al. | 713/1 |
| 7,224,912 | B2 | 5/2007 | Rommelmann et al. | 399/8 |
| 7,231,153 | B2 | 6/2007 | May | 399/25 |
| 7,307,531 | B2 | 12/2007 | Rommelmann et al. | 340/572.1 |
| 2006/0133609 | A1 * | 6/2006 | Rodriguez et al. | 380/201 |
| 2006/0153578 | A1 * | 7/2006 | May | 399/12 |
| 2006/0257155 | A1 | 11/2006 | Schlafer et al. | 399/12 |
| 2007/0252718 | A1 | 11/2007 | Ray | 340/679 |
| 2007/0252719 | A1 | 11/2007 | Ray | 340/679 |
| 2008/0181625 | A1 * | 7/2008 | Moodie et al. | 399/24 |
| 2008/0232870 | A1 * | 9/2008 | Ardery et al. | 399/329 |

* cited by examiner

*Primary Examiner* — David Gray
*Assistant Examiner* — David Bolduc
(74) *Attorney, Agent, or Firm* — Alix, Yale & Ristas, LLP

(57) ABSTRACT

A replaceable unit monitor assembly includes a substrate member, multiple thermal insulating stand-off members, and a monitor device mounted on the substrate member. The stand-off members mount the substrate member to an end hub of a fuser roll of a printing machine while limiting conductive heat transfer to the monitor device.

19 Claims, 2 Drawing Sheets

APPARATUS AND METHOD FOR MOUNTING AN RF MONITORING DEVICE ONTO A FUSER ROLL

BACKGROUND

This disclosure relates generally to a customer replaceable unit (CRU) or a field support engineer (tech rep) replaceable unit (ERU) for a printing machine. More particularly, the present disclosure relates to monitors for customer replaceable units and engineer replaceable units.

In a typical electrographic or xerographic copying or printing process, a charge retentive surface such as a photoconductive member is charged to a substantially uniform potential so as to sensitize the surface thereof. The charged portion of the photoconductive member is selectively exposed to light to dissipate the charges thereon in areas subjected to the light. This records an electrostatic latent image on the photoconductive member. After the electrostatic latent image is recorded on the photoconductive member, the electrostatic latent image is rendered visible by bringing one or more developer materials into contact therewith. Generally, the developer material comprises toner particles adhering triboelectrically to carrier granules. The toner particles are attracted from the carrier granules either to a donor member or to a latent electrostatic image on the photoconductive member. When attracted to a donor member, the toner particles are subsequently deposited on the latent electrostatic images. The toner powder image is then transferred from the photoconductive member to a final substrate or imaging media. The toner particles forming the toner powder images are then subjected to a combination of heat and/or pressure to permanently affix the powder images to the substrate.

A fuser assembly is commonly used to heat the toner material and cause it to fuse to the substrate. The assembly includes a fuser roll that rotates around an axis as the substrate is drawn between it and a pressure roll. Heat is applied to the toner material via the fuser roll during this drawing process. Fuser rolls typically operate at temperatures up to approximately 200° C.

Many machines have replaceable sub-assemblies. Printing machines, for example, may have a number of replaceable sub-assemblies such as a fuser print cartridge, a toner cartridge, or an automatic document handler. These subassemblies may be arranged as unit called a cartridge, and if intended for replacement by the customer or machine owner, may be referred to as a CRU. Examples of a CRU may include a printer cartridge, a toner cartridge, or a transfer assembly unit. It may be desirable for a CRU design to vary over the course of time due to manufacturing changes or to solve post-launch problems with either the machine, the CRU, or a CRU and machine interaction. Further, design optimizations may be recognized subsequent to design launch and machine sale that a relatively simple code update might realize. However, solving these problems, or providing optimization updates, generally requires a field service call to accomplish.

U.S. Pat. No. 6,016,409 to Beard et al. discloses a fuser module which includes an electronically readable memory permanently associated therewith. The control system of the printing apparatus reads out codes from the electronically-readable memory at installation to obtain parameters for operating the module, such as maximum web use, voltage and temperature requirements, and thermistor calibration parameters.

The fuser roll that is a component of the fuser module may be replaced independently of the other fuser module components. Accordingly, it would be advantageous to have a monitor installed on the fuser roll, and not as part of the entire fuser module assembly. However, the hostile environment to which fuser rolls are subjected, 200° C., exceeds the limits of conventional monitor devices, generally less than 125° C.

SUMMARY

There is provided a replaceable unit monitor assembly comprising a substrate member, multiple thermal insulating stand-off members adapted to mount the substrate member to an end hub of a fuser roll of a printing machine, and a monitor device mounted on the substrate member.

The substrate member is ring-shaped, having oppositely disposed front and back surfaces and oppositely disposed inner and outer edges.

The substrate member may be composed of a high temperature ceramic or a thermoset laminate material.

A first set of the stand-off members are mounted to the inner edge of the circuit substrate member. The first set of stand-off members is adapted for mounting to an outer shaft face of the fuser roll end hub.

A second set of the stand-off members may be mounted to the back surface of the circuit substrate member. The second set of stand-off members is adapted for mounting to a front face of the fuser roll end hub.

Each of the stand-off members has a thickness of 1 to 3 millimeters. The. stand-off members are composed of thermal insulating ceramic material.

The monitor device includes a monitor circuit and an antenna in communications with the monitor circuit. The monitor circuit and the antenna may be connected to the front surface of the substrate member, with the antenna having a C-shape. The monitor circuit may be connected to the front surface of the substrate member, with the antenna being connected to the back surface of the substrate member and having an annular shape.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

With reference to the drawings wherein like numerals represent like parts throughout the several figures, a replaceable unit monitor assembly for use on a fuser roll of a printing machine in accordance with the present disclosure is generally designated by the numeral 10, 10'.

Figure 1:
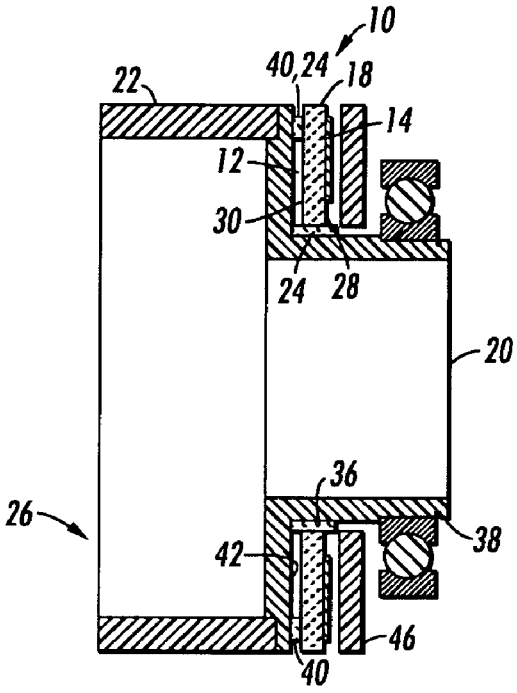
FIG. 1 is a cross-sectional view of a first embodiment of a replaceable unit monitor mounted on an end of a fuser roll.
Figure 2:
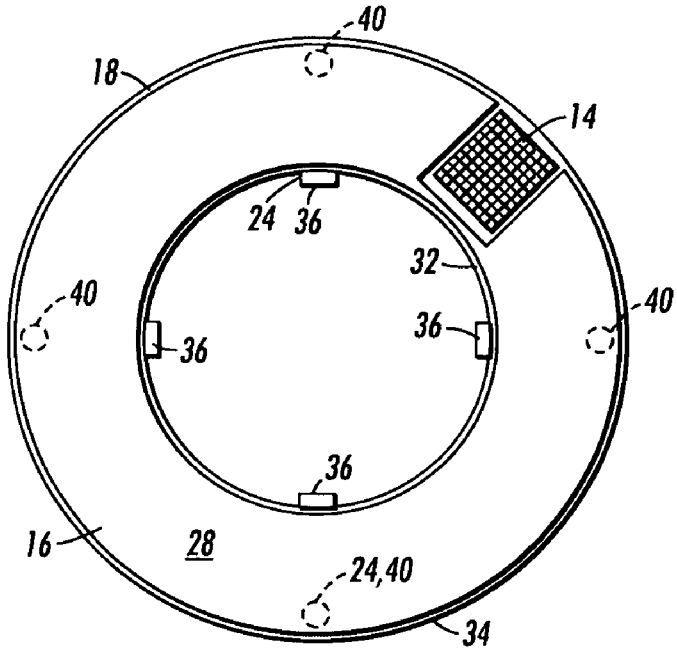
FIG. 2 is an end view of the replaceable unit monitor of FIG. 1.
Figure 4:
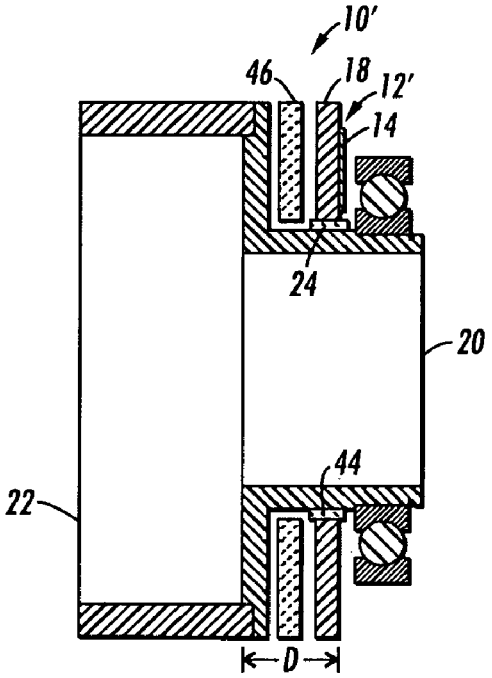
FIG. 4 is a cross-sectional view of a second embodiment of a replaceable unit monitor mounted on an end of a fuser roll.

A monitor device is hereby defined to be a device having a memory, capable of storing at least a fixed datum, and a communications element. With reference to FIGS. 1, 2 and 4, the monitor device 12,12' has a monitor circuit 14 and an antenna 16, 16' in communications with the monitor circuit 14. The monitor circuit 14 includes the memory. The monitor circuit 14 and the antenna 16, 16' may be mounted on a circuit substrate member 18. Alternatively, the monitor circuit 14, antenna 16,16' and circuit substrate member 18 may at least partially be manufactured as an integral assembly.

The substrate member 18 is mounted to one of the fuser roll end hubs 20. Fuser roll cores 22 are generally maintained at temperatures on the order of 200° C. during normal operation. Fuser roll cores 22 and end hubs 20 are conventionally composed of aluminum and stainless steel, respectively. Since there is a relatively high heat transfer coefficient between the materials, the end hubs 20 are generally also at temperatures on the order of 200° C. during normal operation. The monitor circuit 14 must be kept below 125° C., and preferably below 85° C. to prevent premature failure of the circuit 14. Interposing thermal insulators 24 between the fuser roll end hubs 20 and the substrate member 18 allows the monitor device 12, 12' to be mounted to the fuser roll 26 without subjecting it to temperatures that will cause premature failure.

The substrate member 18 is ring-shaped, having oppositely disposed front and back surfaces 28, 30 and oppositely disposed inner and outer edges 32, 34. The substrate member 18 may be a high temperature ceramic, such as Kyocera™ A-493 sintered alumina, or a thermoset laminate material, such as Acculam™ G-7. The thermal insulators or stand-off members 24 are composed of thermal insulating ceramic material, for example zirconium oxide ceramic, that substantially prevents conductive transfer of heat from the fuser roll end hubs 20 to the circuit substrate member 18. In one variation, the stand-off members 24 are monolithic protrusions of the material of the substrate member 18 that extend from the back surface 30 of the substrate member 18.

In the embodiment of FIGS. 1 and 2, a first set 36 of stand-off members 24 are disposed between the inner edge 32 of the circuit substrate member 18 and an outer shaft face 38 of the fuser roll end hub 20, and a second set 40 of stand-off members 24 are disposed between the back surface 30 of the circuit substrate member 18 and a front face 42 of the fuser roll end hub 20. Each set 36, 40 of stand-off members 24 may include 3 or 4 stand-off members 24, with the stand-off members 24 being substantially evenly angularly spaced. The thickness of the stand-off members 24 is 1 to 3 millimeters to prevent direct contact between the circuit substrate member 18 and the fuser roll end hub 20. The cross-sectional area of the stand-off members 24 is selected to minimize the total contact area of the circuit substrate member 18 with the end hub 20, allowing the use of materials that are more thermally conductive than would be required to maintain the monitor circuit temperature within an allowable range. Similarly, a minimum number of stand-off members 24 are used to minimize the total contact area of the circuit substrate member 18 with the end hub 20.

In the embodiment of FIG. 4, a single set 44 of stand-off members 24 are disposed between the inner edge 32 of the circuit substrate member 17 and the outer shaft face 38 of the fuser roll end hub 20 at a distance D selected to facilitate mounting the coupler board 46 between the back surface 30 of the circuit substrate member 18 and the front face 42 of the fuser roll end hub 20. The single set 44 of stand-off members 24 may include 3 or 4 stand-off members 24, with the stand-off members 24 being substantially evenly angularly spaced. The additional space between the hot fuser roll end hub 20 and the monitor circuit 14 mounted on the circuit substrate member 18 reduces convective heating of the air in the region of the monitor circuit 14 below 50° C. Similar to the first embodiment 10, a minimum number of stand-off members 24 are used and the cross-sectional area of the stand-off members 24 is selected to minimize the total contact area of the circuit substrate member 18 with the end hub 20.

The monitor circuit 14 cannot be hard-wired to the copier since the fuser roll 26 rotates during operation. Accordingly, the antenna 16, 16' is required to provide power to the monitor circuit 14 and to provide communications with the copier. In the second embodiment 10', the monitor circuit 14 is mounted to the front surface 28 of the circuit substrate member 18 and the antenna 16' is mounted on the back surface 30 of the circuit substrate member 18. Accordingly, the antenna 16' forms a complete annulus around the fuser roll shaft 48. This means that the antenna 16' will always be adjacent the active antenna region 50 of the coupler/communications board 46 ensuring that communications with the monitor device 12' is always possible. However, it is not necessary that the antenna 16, 16' completely surround the circuit substrate member central opening in order to achieve good communications.

For example, in the first embodiment 10', both the antenna 16 and the monitor circuit 14 are mounted on the front surface 28 of the circuit substrate member 18, creating a "C" shaped antenna 16. The monitor circuit 14 occupies only a small segment of the circuit substrate member front surface 28, with the remaining segment of the circuit substrate member front surface 28 being occupied by the antenna 16. Although such a configuration may result in a disruption in communications, such a disruption may be eliminated or reduced to an insignificant value by selection of the speed of rotation of fuser roller, shaft diameter, data packet size, the amount overlap of the antennas, etc.

Figure 3:
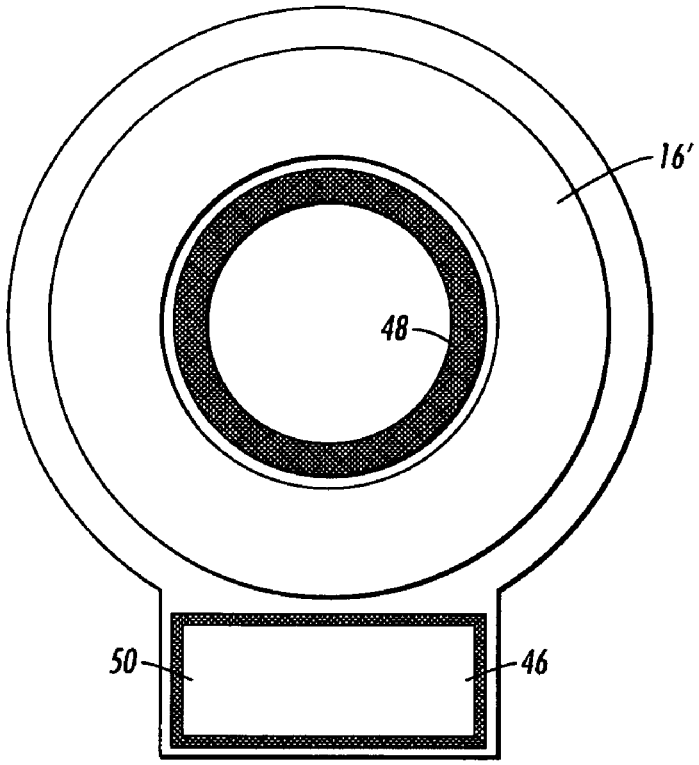
FIG. 3 is a simplified end view of a coupling board and the fuser roll and replaceable unit monitor of FIG. 1.

FIG. 3 shows the copier coupler/communications board 46 looking down the fuser roll axis. The coupler/communications board 46 is positioned concentric to the fuser roll shaft 48 at the "Z" axis location relative to the fuser roll shaft 48 such the coupler/communications board 46 is proximate to the circuit substrate member 18 and the antenna 50 mounted thereon. It should be appreciated that the RF coupler/communications circuit located on the board 46 is located at a sufficient distance from the fuser roll shaft that it is not subject to the heat generated by the fuser roll core.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A replaceable unit monitor assembly comprising:

a substrate member having oppositely disposed front and back surfaces;

a plurality of thermal insulating stand-off members adapted to mount the substrate member to an end hub of a fuser roll of a printing machine; and a monitor device mounted on the substrate member, the monitor device including:

a monitor circuit; and an antenna in communications with the monitor circuit;

wherein monitor circuit is connected to the front surface of the substrate member and the antenna is connected to the back surface of the substrate member.

2. The assembly of claim 1 wherein the substrate member is ring-shaped, and has oppositely disposed inner and outer edges.

3. The assembly of claim 2 wherein the substrate member is composed of a high temperature ceramic or a thermoset laminate material.

4. The assembly of claim 2 wherein a first set of the stand-off members are mounted to the inner edge of the substrate member, the first set of the stand-off members being adapted for mounting to an outer shaft face of the fuser roll end hub.

5. The assembly of claim 4 wherein a second set of the stand-off members are mounted to the back surface of the substrate member, the second set of the stand-off members being adapted for mounting to a front face of the fuser roll end hub.

6. The assembly of claim 1 wherein each of the stand-off members has a thickness of 1 to 3 millimeters.

7. The assembly of claim 1 wherein the stand-off members are composed of thermal insulating ceramic material.

8. The assembly of claim 1 wherein the stand-off members and the substrate member are a monolithic element.

9. The assembly of claim 2 wherein the monitor device includes:

a monitor circuit; and an antenna in communications with the monitor circuit;

wherein the monitor circuit and the antenna are connected to the front surface of the substrate member.

10. The assembly of claim 9 wherein the antenna has a C-shape.

11. A replaceable unit monitor assembly comprising:

a C-shaped substrate member having oppositely disposed front and back surfaces, and oppositely disposed inner and outer edges;

a plurality of thermal insulating stand-off members adapted to mount the substrate member to an end hub of a fuser roll of a printing machine a first set of the stand-off members being mounted to the inner edge of the substrate member, and a second set of the stand-off members being mounted to the back surface of the substrate member; and a monitor device including a monitor circuit connected to the front surface of the substrate member, and an antenna connected to the back surface of the substrate member, the antenna being in communications with the monitor circuit.

12. The assembly of claim 11 wherein the substrate member is composed of a high temperature ceramic or a thermoset laminate material.

13. The assembly of claim 11 wherein each of the stand-off members has a thickness of 1 to 3 millimeters.

14. The assembly of claim 11 wherein the stand-off members are composed of thermal insulating ceramic material.

15. A replaceable unit monitor assembly comprising:

a ring-shaped substrate member having oppositely disposed front and back surfaces, and oppositely disposed inner and outer edges;

a plurality of thermal insulating stand-off members mounted to the inner edge of the substrate member, the stand-off members being adapted to mount the substrate member to an end hub of a fuser roll of a printing machine; and a monitor device including a monitor circuit connected to the front surface of the substrate member, and an antenna connected to the back surface of the substrate member, the antenna being in communications with the monitor circuit.

16. The assembly of claim 15 wherein the substrate member is composed of a high temperature ceramic or a thermoset laminate material.

17. The assembly of claim 15 wherein the stand-off members and the substrate member are a monolithic element.

18. The assembly of claim 15 wherein the stand-off members are composed of thermal insulating ceramic material.

19. A fuser roll assembly of a fuser assembly of a printing machine comprising:

a fuser roll having oppositely disposed ends;

an end hub mounted to at least one of the ends of the fuser roll; and a replaceable unit monitor assembly including a substrate member having oppositely disposed front and back surfaces, a plurality of thermal insulating stand-off members mounting the substrate member to the end hub, and a monitor device mounted on the substrate member, the monitor device including:

a monitor circuit; and an antenna in communications with the monitor circuit;

wherein monitor circuit is connected to the front surface of the substrate member and the antenna is connected to the back surface of the substrate member.

* * * * *